US010941604B2

(12) United States Patent
Lombardi

(10) Patent No.: US 10,941,604 B2
(45) Date of Patent: Mar. 9, 2021

(54) SAFETY BOX

(71) Applicant: Eugenio Lombardi, Rome (IT)

(72) Inventor: Eugenio Lombardi, Rome (IT)

( * ) Notice: Subject to any disclaimer, the term of this patent is extended or adjusted under 35 U.S.C. 154(b) by 138 days.

(21) Appl. No.: 16/311,196

(22) PCT Filed: Jul. 6, 2017

(86) PCT No.: PCT/IB2017/054071
§ 371 (c)(1),
(2) Date: Dec. 19, 2018

(87) PCT Pub. No.: WO2018/007969
PCT Pub. Date: Jan. 11, 2018

(65) Prior Publication Data

US 2019/0234133 A1 Aug. 1, 2019

(30) Foreign Application Priority Data

Jul. 6, 2016 (IT) ..... UA2016A004968

(51) Int. Cl.
*E05G 1/04* (2006.01)
*E05B 65/00* (2006.01)
*E05G 1/00* (2006.01)

(52) U.S. Cl.
CPC ..... *E05G 1/04* (2013.01); *E05B 65/0075* (2013.01); *E05G 1/005* (2013.01)

(58) Field of Classification Search
CPC ..... E05G 1/04; E05G 1/005; E05B 65/0075
USPC ..... 70/58, 63, 158, 163–173; 109/45, 47, 109/50–52; 220/476, 477, 480, 481; 248/551–553
See application file for complete search history.

(56) References Cited

U.S. PATENT DOCUMENTS 1,240,981 A * 9/1917 Kohl ..... E05B 37/12 70/304
2,026,977 A * 1/1936 Jaeger ..... E05G 1/024 109/52
2,410,475 A * 11/1946 Church ..... E05G 1/005 109/52
3,415,086 A * 12/1968 Trainor ..... E05C 5/02 70/240
3,552,791 A * 1/1971 Watermann ..... E05B 85/045 292/340

(Continued)

FOREIGN PATENT DOCUMENTS

FR 1415669 A 10/1965
GB 1154671 A 6/1969

OTHER PUBLICATIONS

International Search Report and Written Opinion for Corresponding International Application No. PCT/IB2017/054071 (11 Pages) (dated Oct. 13, 2017).

*Primary Examiner* — Lloyd A Gall
(74) *Attorney, Agent, or Firm* — Lucas & Mercanti, LLP

(57) ABSTRACT

A portable safety container configured also for fixed installation is disclosed having a main body, which, in turn has a covering element and a containment structure. The main body also is selectively coupled with a support body and a lock element. The lock element is configured so that a locking configuration of the covering element with the containment structure corresponds to a first closing state, and an additional locking of the main body with the support body corresponds to a second closing state.

19 Claims, 6 Drawing Sheets

(56) References Cited

U.S. PATENT DOCUMENTS

| | | | | | |
|---|---|---|---|---|---|
| 4,244,304 | A * | 1/1981 | Read | E05G 1/08 | 109/52 |
| 4,339,629 | A * | 7/1982 | Stanmore | H02G 3/14 | 174/50 |
| 4,454,824 | A * | 6/1984 | Wood | A45F 3/44 | 109/50 |
| 4,577,563 | A * | 3/1986 | Sidler | E05G 1/005 | 109/52 |
| 4,987,836 | A * | 1/1991 | Owen | E05B 67/36 | 109/52 |
| 5,170,907 | A * | 12/1992 | Sakai | A45C 13/18 | 109/52 |
| 8,695,386 | B2 * | 4/2014 | Schulz | E05G 1/005 | 70/63 |
| 8,826,704 | B1 * | 9/2014 | Marshall | E05G 1/02 | 70/63 |
| 2011/0073019 | A1 * | 3/2011 | Chow | E05G 1/00 | 109/50 |
| 2014/0076208 | A1 | 3/2014 | Schulz | | |

* cited by examiner

SAFETY BOX

CROSS-REFERENCE TO RELATED APPLICATIONS

This application is a 371 of PCT/IB2017/054071, filed Jul. 6, 2017, which claims the benefit of Italian Patent Application No. 102016000070386, filed Jul. 6, 2016.

TECHNICAL FIELD OF THE INVENTION

The present invention relates to the field of the containers equipped with safety locks, such as for example safes. The invention in particular relates to a safety container configured to be suitable for a double use, as fixed device and as mobile device.

BACKGROUND

Safes, as more in general the safety containers for keeping personal or valuable objects, are devices implemented according to numerous different configurations.

In particular, two categories of safety containers of known type can be distinguished, aimed at fulfilling different needs: the fixed safes and the portable security cases or safe deposit boxes. The aspect common to such containers is to provide safety locking systems allowing that the container can be opened exclusively by whoever has a specific key or opening combination.

Fixed safes are installed permanently in support structures like walls or floors, and it is not provided that they can be disengaged from such structures. On the contrary, the installation modes of these safes are intended exactly to avoid that the safe could be removed from its installation seat.

As far as the security cases or safe deposit boxes of mobile type are concerned, they are specifically dedicated to keep properties and values which have to be moved and transported, for example sensitive documents which are required to be moved outside the working place.

Then, when it is necessary to transport a valuable property usually a safe deposit box of mobile type is used, whereas once the property has reached the destination, it is transferred into a safe of fixed type (and viceversa).

Disadvantageously, when a shifting of a valuable property as just described is performed, it is necessary to have at disposal two types of safety containers, as well as to perform laborious and in case difficult procedures for transferring the properties from one type of container to the other one.

Some containers have been proposed capable of being transported, but even, if required, locked to a wall. However, the modes for closing and locking such containers to the wall generally are complex and the containers themselves result difficult to be handled.

SUMMARY OF THE INVENTION

The technical problem placed and solved by the present invention then is to obviate the drawbacks mentioned above with reference to the known art.

Such problem is solved by a safety box according to present invention.

Furthermore the present invention relates to a safety system using the above-described safety box.

Preferred features of the present invention are set forth in the depending claims.

The present invention relates to a safety container, meant in a wide meaning to include any safety box and device for keeping valuable properties, such as for example money, documents or personal objects, or however objects of any type. Such container is configured to implement a double, fixed and mobile, installation. According to preferred embodiments of the invention, advantageously one passes in a simple and quick way from one configuration to the other one.

The safety container of the invention first of all comprises a main body, implemented by means of a containment structure of the properties to be kept and a corresponding covering element, of the closing means (in particular a lock) and a support body. The support body can be fixed to a support structure for installing the container according to a fixed mode, that is so that it acts as safe.

In the following detailed description it will be appreciated that by actuating the closing means, both the closing of the main body (that is the covering element on the containment group) and the connection thereof to the support body can be easily implemented, in reversible way. In particular, the closing means can be actuated according to two closing levels: with the first closing level the covering element is fixed to the containment group (the container is closed), with the second closing level the main body is coupled to the support body (the container becomes a safe fixed to a support structure).

Advantageously, according to preferred embodiments of the invention the support body can be applied (by means of screws, rivets or other fixing systems) to walls, floors, frames or any other support thereto one wishes to fix the safe.

Once the support body has been made integral with a support structure (for example a wall), the main body can be coupled to the support body, in a reversible way.

Advantageously, it is possible to disengage the main body from the support body by making that the covering element remains closed on the containment body. Then, it is possible to detach and move the container by keeping it closed, and the covering element can be opened in a second moment.

If several supporting bodies are available, positioned at different support structures, it is possible to fix the container to anyone of them.

By way of example, let's suppose that a user has several support bodies: one installed in his/her home floor and one on his/her office wall. When the user is at home, he/she can insert properties in the container and close it with the first closing level of the lock, by leaving it mobile. Once arrived at the office, he/she can fix the container to the supporting plate through the second closing level of the lock, without opening the first-level lock, then without ever opening the safe. Upon leaving the office to come back home, the user can detach the container from the supporting plate (however by keeping it closed) and subsequently fix the closed container on the support body assembled at home.

Other advantages, features and use modes of the present invention will result evident from the following detailed description of some embodiments, shown by way of example and not with limitative purposes.

BRIEF DESCRIPTION OF THE FIGURES

The drawings of the enclosed Figures will be referred to, wherein.

The above-mentioned Figures are to be meant by way of example and not with limitative purposes.

DETAILED DESCRIPTION OF PREFERRED EMBODIMENTS

Figure 1:
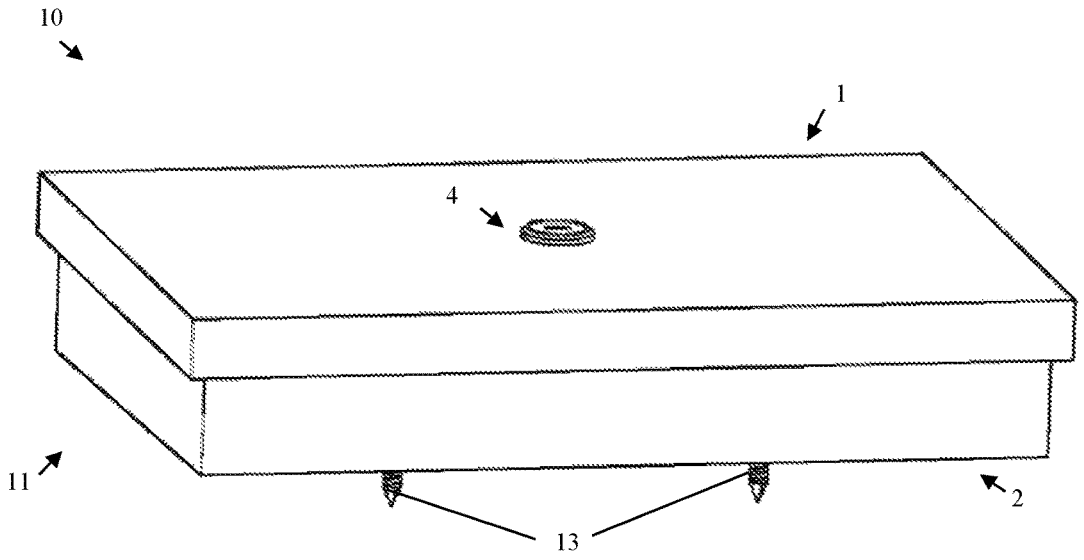
FIG. 1 shows a perspective view of a first preferred embodiment of a safety container according to the present invention.
Figure 2:
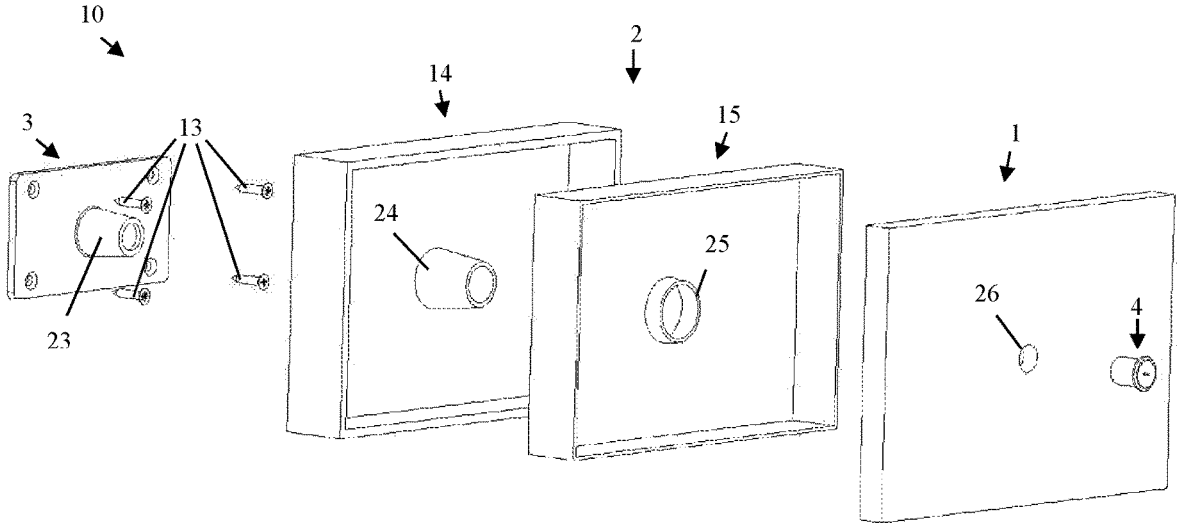
FIG. 2 shows an exploded view of the container of FIG. 1.

By firstly referring to FIGS. 1 and 2, a first preferred embodiment of a safety container according to the present invention is designated as a whole with 10. For sake of simplicity, hereinafter the safety container 10 could be even simply called as safe.

The safe 10 implements a device for containing properties, for example valuable objects, which can be selectively fixed and disengaged with respect to a support structure, such as for example a wall.

The safe 10 first of all comprises a main body 11, which in turn comprises a containment group or structure 2 and a corresponding covering element 1. The safe 10 further comprises closing means 4 and a support body 3, the latter configured to be fixed to a support structure for fixed installations of the main body 11. In particular, the support body 3 is implemented under the form of a plate arranged to be fixed to the support structure by fixing means 13, for example screws, nails or other equivalent means.

Hereinafter it will be appreciated that by actuating the closing means 4 both the closing of the main body 11 and the connection thereof to the support body 3 can be easily implemented, in reversible way.

The containment group 2 is configured to receive the content to be protected into the safe 10, and to this purpose it can have the most varied shapes and sizes.

As shown in FIG. 2, the containment group 2 can comprise one at least partially hollow holding element 14. In the embodiment shown by way of example in the enclosed Figures, the holding element 14 has a parallelepiped shape, open at one side or face for inserting the properties to be protected.

The support body 3, in use, is positioned at a wall of the containment group 2 preferably opposite to such open side.

The holding element 14 preferably is made of highly resistant material, and in case internally lined by means of an inner lining element 15. The lining element 15 can follow closely the shape of the corresponding holding element 14, but it can be made of a softer material, in order not to damage the content of the safe 10. Moreover, depending upon the properties to be protected, the lining 15 can be configured so as to have dedicated seats and/or housings, such as supports for watches, or compartments for inserting paper documents or objects with small sizes, apt to guarantee that the protected properties are not subjected to shifting or excessive bumps during a transportation or shifting phase of the main body 11, when the latter is disengaged from the support structure.

The covering element 1 is configured to couple selectively to the containment group 2 at the open side of the latter to implement the closing of the main body 11, in other words to define a closed safety compartment.

The locking mode or fixed coupling between the covering element 1 and the containment group 2, that is the closing mode of the safe 10, will be described shortly.

The covering element 1 can be integral with the closing means 4, in particular implementable by or comprising a lock element. For example, the covering element 1 can have one fastening seat 26 of the closing means 4. According to alternative embodiments there is removable means for connecting the closing means 4 to the covering element 1.

The closing means 4 is configured for closing the safe 10 by constraining the covering element 1 to the containment group 2.

Figure 3:
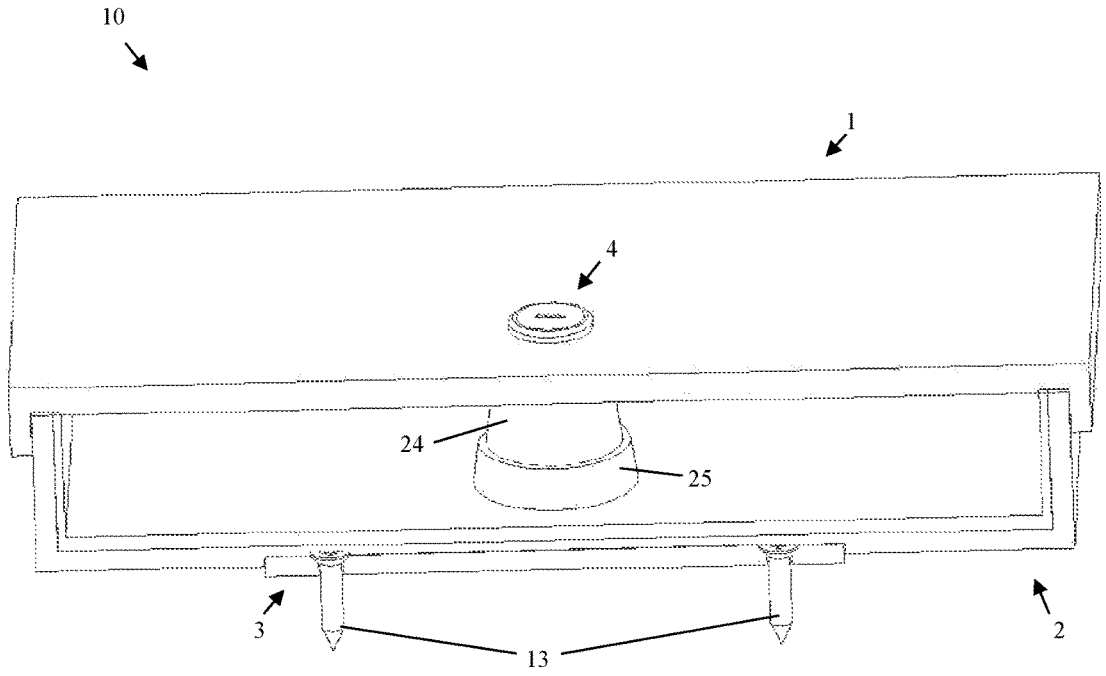
FIGS. 3, 4 and 5 show, by way of example, respective upper perspective section views of the container of FIG. 1.

To this purpose, the containment group 2 has at least a first seat for housing the closing means 4, for example a main seat 24 can be obtained in the holding element 14 and a secondary seat 25 in the lining element 15, as it can be seen even in FIG. 3.

Figure 4:
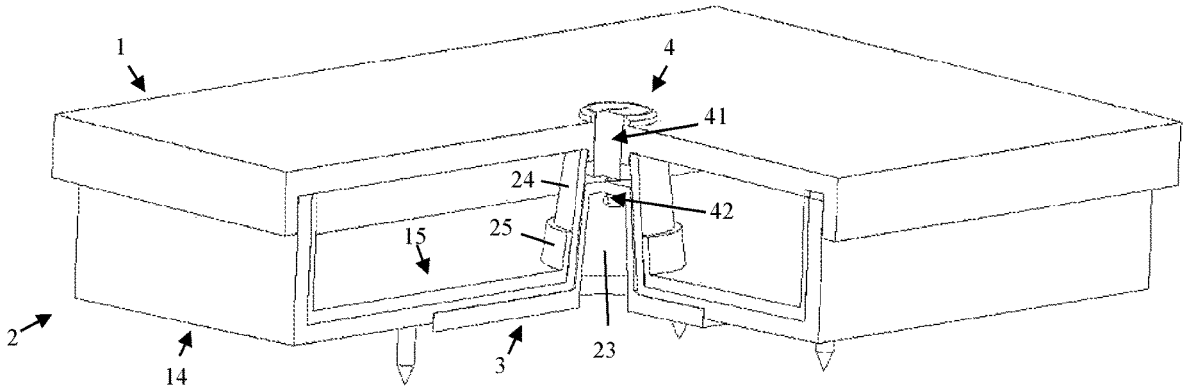

Even the support body 3 bears at least a second seat 23 for housing the closing means 4, a section thereof is shown in FIG. 4.

The closing means 4 preferably is at least partially passing through such seats 23, 24, 25.

The seats 23, 24, 25 for housing the closing means 4 preferably are coaxial, in particular concentric, and they can have a tapered shape, as shown by way of example in FIG. 3. In the preferred embodiment shown in the enclosed Figures, the seats have a substantially frusto-conical configuration, in particular with different height, and they are arranged concentrically. Alternatively, the seats can have a cylindrical configuration or a configuration according to any other geometry and they can be positioned in centered, or eccentric, position with respect to the safe 10, both as to the position of the coupling system and to the coupling system itself. In particular, in use, the second seat 23 is in more internal position, whereas the secondary seat 25 is in more external position.

As already shown, the closing means 4 can be implemented by means of a lock and it preferably comprises corresponding actuation means—for example a key—described more in details hereinafter. According to the embodiment wherein the actuation means comprises a key, the closing means 4 preferably comprises even a keyhole element, configured for inserting the above-mentioned respective key.

According to alternative embodiments of the invention, the closing means 4 can comprise electromechanical systems such as an electronic lock which can be actuated by means of an electronic key (RFID type), bluetooth signal, nfc or insertion of fingerprint, according to implementation modes well known to the persons skilled in the art. In particular, the electronic lock can include means for connecting to the Internet network to allow the actuation thereof even remotely, by means of suitably programmed electronic control devices.

With reference to the present description, when not specified, under the term 'key' both a key by mechanical actuation of the closing means and an electronic key is meant.

By referring to FIG. 4, the closing means 4, in turn, has a suitably shaped first portion 41 and second portion 42. In particular, the first portion 41 is configured in such a way as to implement selectively a fixed coupling with the first seat, or better with the main and secondary seats 24, 25 of the containment group 2, and the second portion 42 is configured in such a way as to implement selectively a fixed coupling with the second seat 23 of the support body 3.

In other words, the configuration of the two portions 41, 42 of the closing means 4 is so that they can be housed or received, in use, in the respective seats obtained on the containment body 2 and on the support body 3, and selectively they can be constrained in fixed, but reversible manner, to such seats.

To this purpose, the first portion 41 can comprise a traditional cylinder-bolt type mechanism (not represented for sake of simplicity), which can be actuated for example by means of a first rotation of the closing means 4, and apt to implement a fixed coupling with the main and secondary seats 24, 25 of the containment group 2. To implement such coupling, said seats have a suitable slot indeed for inserting the bolt, which when it engages such slot actually implements a connection by obstacle between the containment body 2 and the covering element 1. The modes for implementing such solution are widely known to the persons skilled in the art, therefore they will not be further examined closely. Alternatively, the first portion 41 can comprise small pistons which selectively can be made to go out in radial direction with respect to the closing means themselves, to engage in housings obtained in the respective main and secondary seats 24, 25, 23.

Figure 5:
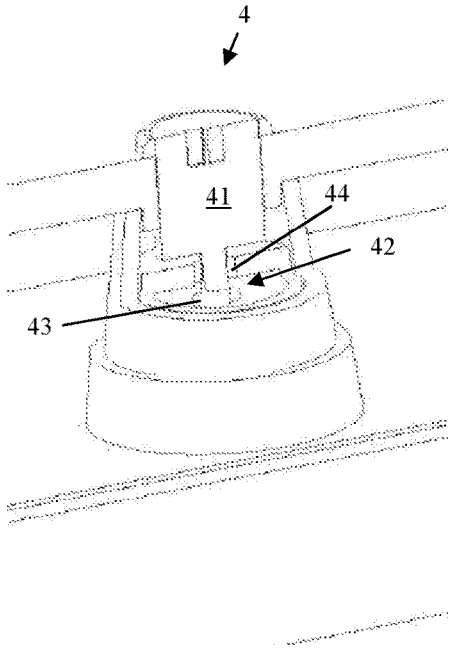
Figure 6:
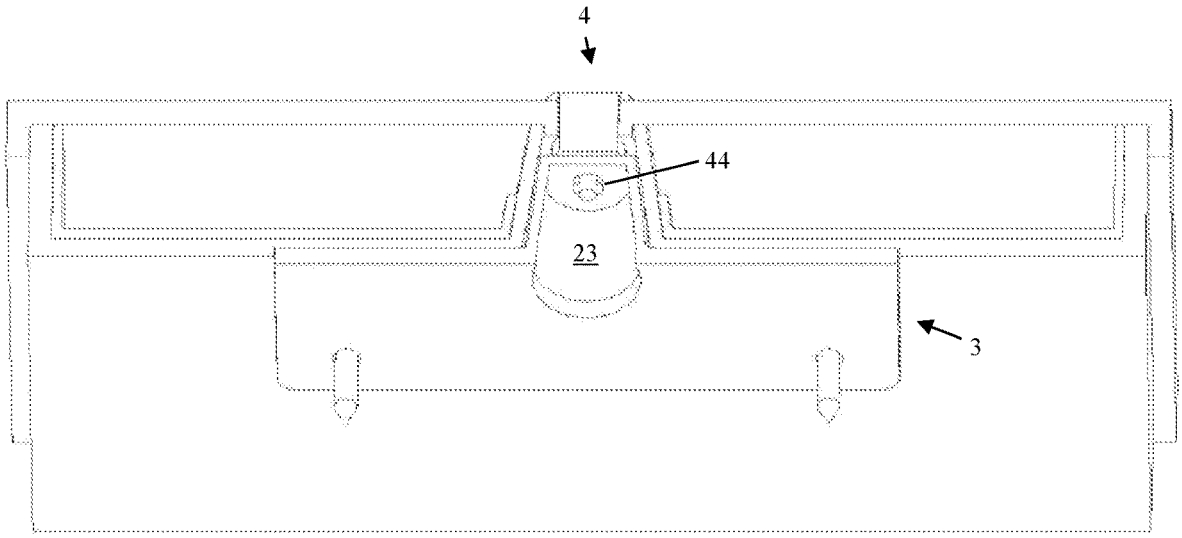
FIG. 6 shows, by way of example, a lower perspective view, partially in section, of a detail of the container of FIG. 1.

As still shown in FIG. 4, and more in detail in FIGS. 5 and 6, according to the preferred embodiment of the safe 10 of the herein described invention, the second portion 42 of the closing means 4 has a terminal end, opposite to the possible keyhole element, having one or more interference elements 43 with a section of the second inlet seat 23 of the closing means 4. Such elements 43 can be for example projections, in particular it is possible to provide such terminal end shaped like an overturned T, with the arms of the T implementing such projections. Correspondingly, the second seat 23 bears one or more openings 44 shaped to allow a selective passage of the above-mentioned interference elements 43, that is to allow the passage thereof exclusively at a determined relative orientation between projections 43 and openings 44, according to modes which will be described shortly.

According to an alternative embodiment of the invention, not shown in the enclosed Figures, the second portion 42 of the closing means 4 has at least a first segment externally threaded like a screw, and said second seat 23 has at least a second segment internally threaded like a nut screw. Such first and second segment are configured to couple to implement a threaded, fixed but reversible, connection by means of a suitable rotation of the closing means 4.

Alternatively, it is possible to provide additional embodiment variants of the systems for locking the main body 11 to the support body 3, for example the closing means 4 can comprise a cam apt to implement selectively a configuration for the engagement/interference at least with the second seat 23 of the support body 3.

Still, the second portion 42 can comprise small pistons configured to engage with the second seat 23. In fact, according to an additional preferred embodiment of the invention, by means of a first rotation of the closing means 4 it is possible to actuate the outgoing of small pistons from the first portion 41 which engage only the main body 11, and with a second rotation it is possible to actuate the outgoing of additional small pistons from the second portion 42 which engage with the support body 3.

The coupling according to the just described exemplifying modes is then determined by the actuation of the closing means 4 by the respective actuation means. In particular, the actuation of the closing means 4 can be manual or automatized, for example it can take place by using an electronic transponder.

According to a preferred embodiment of the invention, the actuation means of the closing means 4 can comprise a key suitably configured for an effective insertion in the keyhole element. Alternatively to the key, the actuation means can comprise for example a numeric keypad or a knob, and respective mechanisms/implementation electronics. Still, the actuation means of the closing means 4 can comprise an electronic key, according to what already described.

The actuation means is configured to be actuated (for example in rotation or in translation) with the purpose of implementing indeed an actuation of the closing means 4, in particular a related rotation of such closing means 4 with respect to the housing seats 23, 24, 25.

The preferred modes for closing and connecting to the support body 3 of the main body 11 of the safe 10 according to the present invention will be now described. By sake of simplicity, hereinafter the closing means will be designated as lock element 4.

Let's consider initially a configuration wherein the main body 11 is open and the containment group 2 is not fixed to the support body 3, designated as opening configuration or arrangement. In this configuration, the lock element 4 results to be uncoupled with the housing main seat, secondary seat and second seat 24, 25, 23, even when the covering element is abutted on the open side of the containment body 2. In the latter case, the lock element 4 is inserted inside the respective housing seats, but not coupled in fixed way therewith, then the covering element 1 can be freely lifted and the safe 10 opened. Furthermore, the support body 3 is not fixed to the containment group 2, on the contrary it can be in a remote position with respect thereto. In such configuration, if the main body 11 is coupled with the support body 3, the lock element 4 is through-inserted in the seat 23, in particular the orientation of the possible interference elements 43 is so as to allow freely the input (and then the output) of the lock element 4 through the openings 44.

After the properties to be protected have been introduced in the safe 10, the closing thereof can be performed, that is locking the covering element 1 on the containment body 2 to implement a first closing configuration. To implement the closing, the lock element 4 is actuated by the actuation means, for example according to a rotation motion by a first predetermined angle $\alpha$ with respect to the opening configuration. By means of such first rotation, the first portion 41 implements a fixed coupling with the first seat of the containment group 2, which corresponds to a locking of the covering element 1 indeed with respect to the containment group 2.

For example, the closing can take place by turning the key in the keyhole of the lock element 4, with such rotation by actuating a mechanism of the already described cylinder-bolt type. Meanwhile, the second portion 42, even if preferably it is integral with the first portion 41 during the actuation in rotation of the lock element 4, remains uncoupled with respect to the second seat 23, since for example the interference elements 43 still result to be oriented so that they can pass freely through the openings 44 of the second seat 23.

Once the main body 11 has been closed, it is possible to fix it to a support structure by means of the support body 3, by implementing a second closing configuration. In order to obtain the fixed coupling between the containment group 2 and the support body 3, preferably made integral with the support structure, the lock element 4 is further actuated by the actuation means. For example, the actuation takes place according to an additional rotation motion having a width equal to a second predetermined angulation β with respect to the first closing configuration. By means of such additional second rotation, the second portion 42 implements a fixed coupling with the second seat 23, which corresponds to a locking of the main body 11 with respect to the support body 3.

For example, by means of such second rotation, the interference elements 43 are oriented so that they cannot pass freely anymore through the openings 44 of the second seat 23, then the lock element 4 cannot be disengaged or better extracted anymore from the second seat 23.

Preferably, the second predetermined angulation β has a width equal to the first predetermined angulation α.

By firstly referring to FIG. 7, a second preferred embodiment of a safety container or safe according to the present invention, designated as a whole with 10', will be described hereinafter. Such embodiment will be described exclusively in relation to the differences existing with respect to the already described embodiment, and it is likely to be combined therewith where possible.

The safe 10' comprises a main body 11', which in turn comprises a containment group or structure 2' and a corresponding covering element 1. The safe 10 further comprises closing means 4' and a support body 3', the latter configured to be fixed to a support structure for fixed installations of the main body 11'.

In particular, the support body 3' is implemented in the form of a plate, and it can be arranged to be fixed to a support structure by fixing means such as screws, nails or other equivalent means.

Even by referring to this embodiment, by actuating the actuation means of such closing means 4' both the closing of the main body 11' and the connection thereof to the support body 3' can be implemented in reversible way.

The covering element 1 is integral with the closing means 4', which in particular can be implemented by means of a lock element, which means indeed is useful to close the safe 10' by constraining the covering element 1 to the containment group 2'. In particular, the covering element 1 bears a fixing seat 26 of the closing means 4'.

Figure 8:
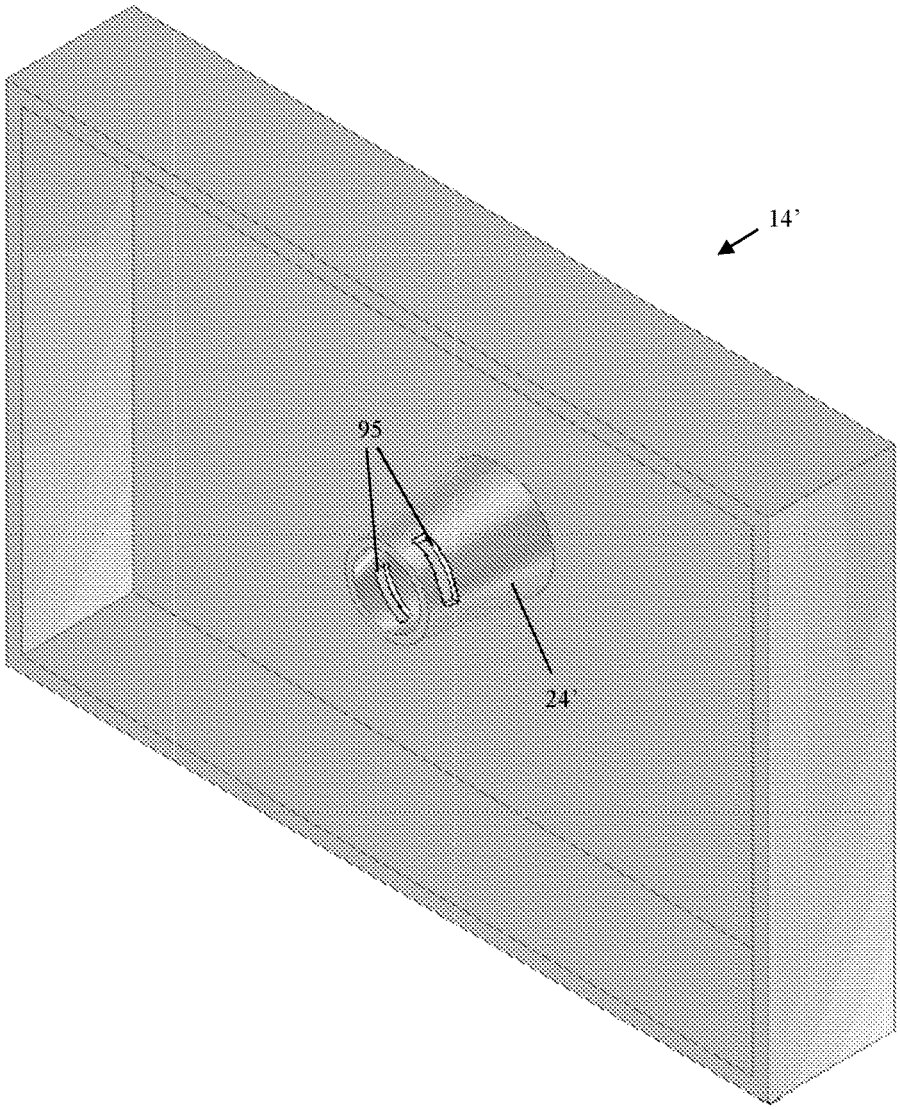
FIG. 8 shows a front perspective view of a holding element of the container of FIG. 7.

To this purpose, the containment group 2 has at least a first seat configured to engage with the closing means 4', for example a main seat 24' obtained in the holding element 14', as shown in FIG. 8.

Figure 9:
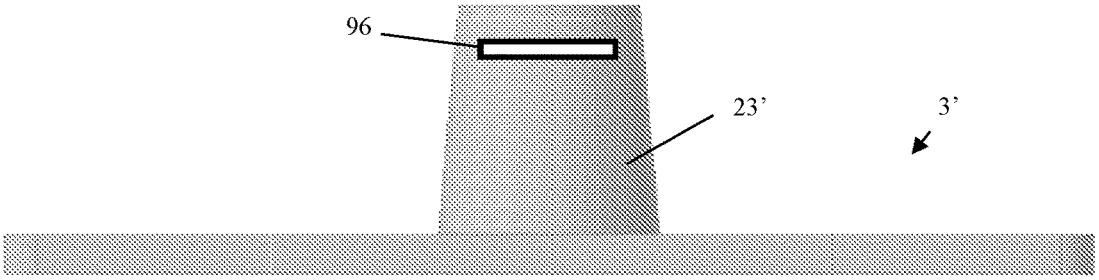
FIG. 9 shows a front view of a support body of the container of FIG. 7.

Even the support body 3' bears at least a second seat 23' configured to engage with the closing means 4', shown in FIG. 9.

The closing means 4' is configured to engage selectively and at least partially with such seats 23', 24', as illustrated in detail hereinafter.

The seats 23', 24' preferably are coaxial, in particular concentric. In particular, in use, the second seat 23' is in internal position with respect to the main seat 24'.

Figure 7:
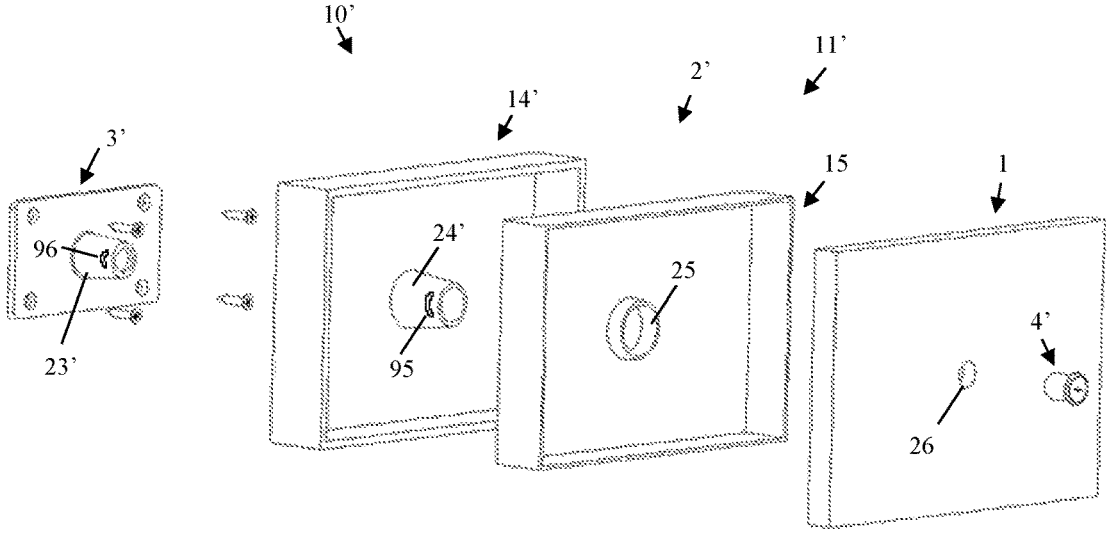
FIG. 7 shows, by way of example, a perspective view in exploded configuration of a second preferred embodiment of a safety container according to the present invention.

The seats 23', 24' can have a tapered shape, as shown by way of example in FIGS. 7, 8 and 9. In the preferred embodiment shown in such Figures, the seats have a substantially frusto-conical configuration, which can have different height, and they are arranged concentrically in use. Alternatively, the seats can have a cylindrical configuration or a configuration according to any other geometry, and they can be positioned in centered, or eccentric, position with respect to the safe 10', both as to the position of the coupling system and to the coupling system itself.

According to the second embodiment, both seats 23', 24' have at least a preferably elongated opening, in particular a slit or slot, preferably on its own side surface having frusto-conical geometry in the enclosed Figures.

Such slots preferably have the same thickness and the same length, where under length the opening prevailing development size is meant and under width the size orthogonal thereto is meant, wherein width and length define the opening surface of the slot itself.

In particular, each seat 23', 24' comprises a pair of slots, in FIGS. 8 and 9 designated with 96 for the seat 23' and 95 for the seat 24', respectively. According to the preferred embodiment the present description relates to, such slots 96, 95 are shaped and/or positioned so that in use configuration of the safe 10' they result to be overlapped. Preferably, such slots have a prevailing development direction which is orthogonal to the axis with respect thereto the seats 23', 24' result to be coaxial, and they are arranged on diametrically opposed portions of the side surface of such seats.

As already shown, the closing means 4' can be implemented by means of a lock and it preferably comprises corresponding actuation means, for example a key, according to what already described. According to the embodiment wherein the actuation means comprises a key, the closing means 4' preferably comprises even a keyhole element, configured for inserting the above-mentioned respective key.

Figure 10:
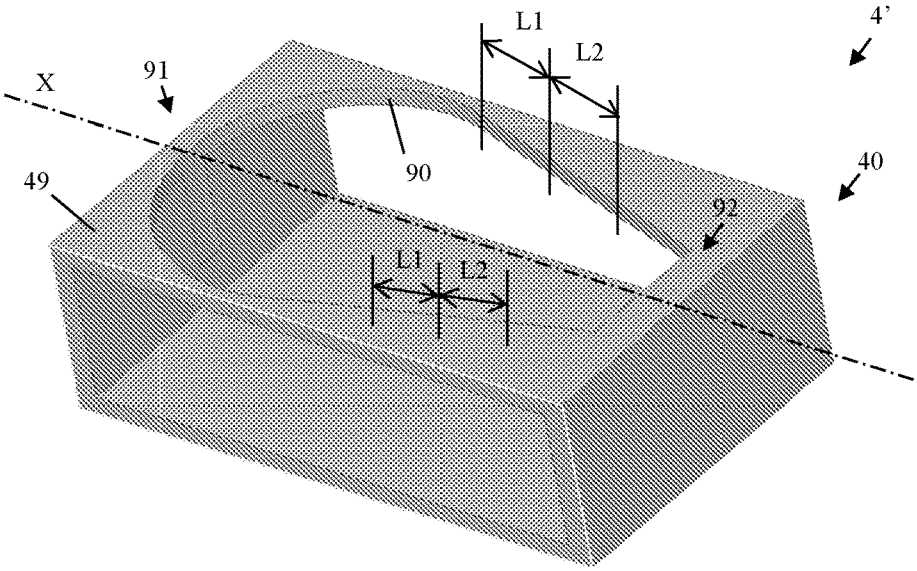
FIG. 10 shows a perspective view of a preferred embodiment of closing means of the container of FIG. 7.
Figure 11:
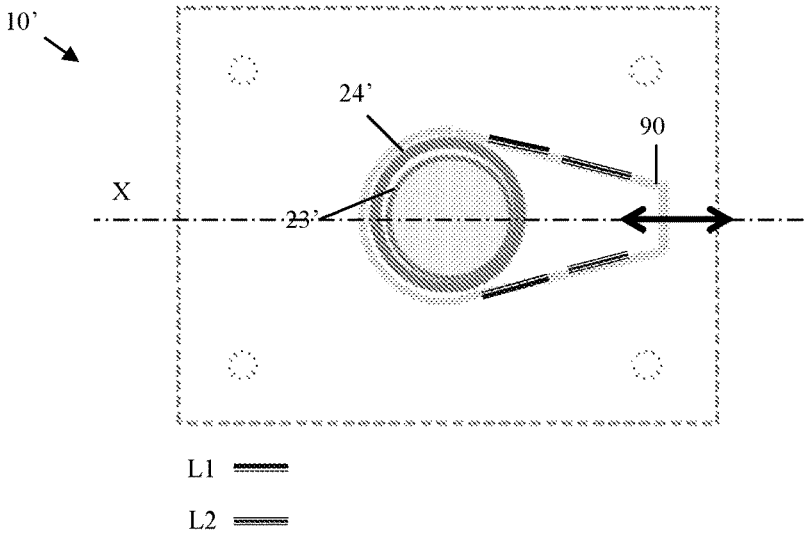
FIGS. 11 to 13 show schematically a plan view of an opening configuration, a first closing configuration and a second configuration for closing and fastening to the support body of the container of FIG. 7, respectively.
Figure 12:
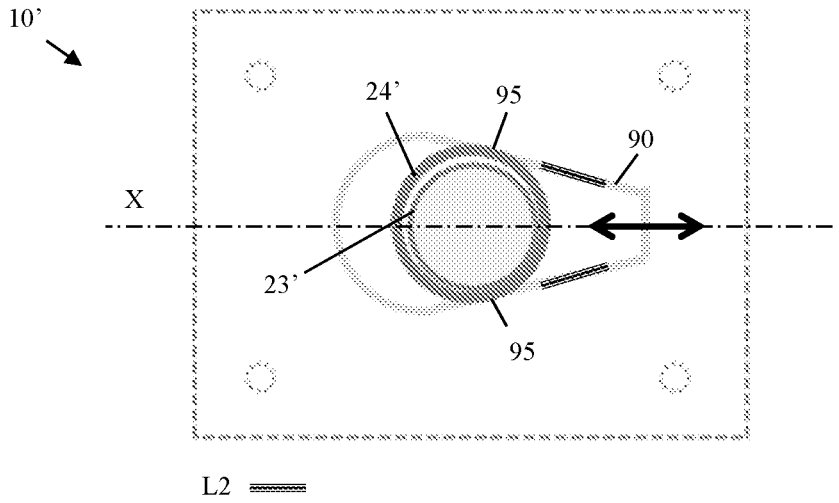
Figure 13:
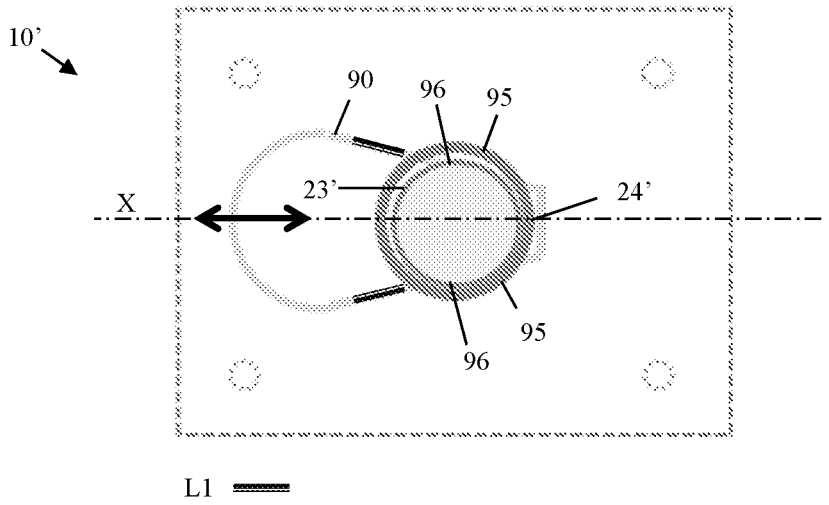

By referring to FIG. 10, the closing means 4' comprises an end bearing a terminal element 40 which has at least a portion configured to engage with the seats 23' and 24'. Such terminal element 40 preferably is positioned in position opposite to the possible keyhole element.

The terminal element 40 comprises interference means configured to engage with the slots 95, 96 of the above-mentioned seats 23', 24'. Such interference means is actuated by means of the actuation means of the closing means 4'. According to the preferred embodiment wherein the actuation means comprises a key and the closing means 4' comprises a keyhole element, the actuation means can be actuated in rotation or in translation, according to the specific configuration of the keyhole/key coupling. According to a preferred embodiment of the closing means 4', a rotation (or translation) of the actuation means corresponds to a translation of the interference means, according to motion transformation mechanisms well known to the persons skilled in the art.

Alternatively, in case the closing means 4' comprises an electronic lock, the translation of the interference means is controlled by means of electronic key or other equivalent actuation means, according to what already described.

In particular, the element 40 can be implemented in the form of a hollow structure apt to receive at least partially the seats 23', 24' when in use. In particular, such structure can be defined like a housing 40, comprising an inner cavity wherein the seats 23', 24' can be received at least partially.

To this purpose, the housing 40 comprises a face 49 bearing or defining an elongated opening 90, configured to allow the insertion of at least a terminal portion of the seats 23', 24'. The face 49 bearing the opening 90 (or the edges defining it) has a thickness smaller than the width of the slots 95, 96, and it is configured to be able to insert inside thereof at the edge region delimiting the opening 90.

The opening 90 has a curvilinear course-shaped profile, in particular symmetrical with respect to a longitudinal symmetry axis X if plan seen (see FIG. 10). The axis X defines even a main extension direction of the opening 90. The opening 90 in particular has a tapered course along the axis X, so as to reduce progressively and symmetrically passing from an end to another one along such axis X.

In particular, the opening 90 has a larger profile portion 91 at one first end along the axis X having a width so as to allow the insertion of at least a terminal portion of the seats 23', 24' inside thereof. According to the preferred embodiment shown in the enclosed Figures wherein the seats have a frusto-conical profile, such portion 91 has a profile like an arc of a circle apt to circumscribe the conical profile of the seats when they are received inside thereof. The profile of the opening 90 has a tapered course starting from the portion 91 by proceeding along the axis X, so that the width of the opening itself reduces progressively.

Respectively, by proceeding along the axis X starting from the portion 91, a first portion of interference profile L1, defining an opening with smaller width than the width at the portion 91, and a second portion of interference profile L2, in turn defining an opening with smaller width than the width at the portion L1, can be found. In particular, the first interference portion L1 defines an opening with smaller width than the overall dimension of the first seat 24', but larger than the overall dimension of the second seat 23'. On the contrary, the second interference portion L2 defines an opening with smaller width than the overall dimension both of the first and of the second seat 24', 23'.

The closing means 4' is configured so that the actuation of its own actuation means causes a sliding of the housing 40, and then of the profile of the opening 90, within one or both slots 96, 95, to implement a fixed coupling by obstacle with one or both seats 23', 24', respectively. The modes for implementing such coupling will be described in details hereinafter, by referring to a preferred embodiment wherein the closing means 4' comprises a keyhole element and the actuation means comprises a corresponding key actuated in rotation within the keyhole.

Let's consider firstly a configuration wherein the main body 11' is open and the containment group 2' is not fixed to the support body 3', designated as opening configuration or arrangement. In this configuration, the opening means 4' results to be uncoupled both with the main seat 24' and with the second seat 23', even when the covering element abuts on the open side of the containment body 2. In fact, in the latter case the main seat 24' and the second seat 23' are inserted into the opening 90 of the housing 40 of the opening means 4', at the larger profile portion 91. As said before, such profile portion 91 defines an opening with larger width than the overall dimension of the seats 23', 24' housed therein. The seats 23', 24' are not coupled in fixed way with the closing means 4' as they can freely pass through the opening 90 at the larger width profile portion 91, then the covering element 1 can be freely raised and the safe 10' is open. Moreover, the support body 3' is not fixed to the containment group 2', on the contrary it can be in a remote position with respect thereto.

After having inserted the properties to be protected in the safe 10', the closing thereof can be performed, that is locking the covering element 1 on the containment body 2' to implement a first closing configuration. In order to implement the locking, the actuation means of the closing means 4' is actuated, for example according to a rotation motion by a first predetermined angle $\alpha$ with respect to the opening configuration.

By means of such first rotation of the actuation means, the housing 40 is placed in translation along the direction defined by its own symmetry axis X, according to a direction moving away from the larger profile portion 91. The configuration of the opening means 4' is so that, by means of the rotation of the actuation means by a predetermined angle $\alpha$ with respect to the opening configuration, the element 40 translates until reaching a first interference configuration of the first portion L1 with the seat 24'.

In particular, the first portion L1 inserts into the slot 96 of the first seat 24', to implement a fixed coupling with the latter. Such configuration corresponds to a locking by obstacle of the covering element 1 with respect to the containment group 2', also defined as first closing configuration.

The closing means 4' is configured so as to remain uncoupled with respect to the second seat 23' after the first translation of the housing 40, as the profile L1 defines an opening with larger width of the seat 23'.

Once the main body 11' has been closed, it is possible to fix it to a support structure by means of the support body 3', by implementing a second closing configuration. In order to obtain the fixed coupling between the containment group 2' and the support body 3', preferably made integral to the support structure, the actuation means of the closing means 4' is further actuated.

For example, the actuation takes place according to an additional rotation motion with width equal to a second predetermined angle $\beta$ with respect to the first closing configuration. Preferably, the second predetermined angle $\beta$ has a width equal to the first predetermined angle $\alpha$.

By means of such second rotation of the actuation means, the housing 40 is placed again in translation according to the direction defined by its own symmetry axis X, still according to the direction moving away from the larger profile portion 91. The configuration of the closing means 4' is so that the element 40 translates until reaching a second interference configuration of the second portion L2 with both seats 24' and 23'.

Such configuration, also defined as second closing configuration, corresponds to a locking of the main body 11' with respect to the support body 3'.

By means of such second rotation, the second portion L2 of the profile of the opening 90 is inserted simultaneously into the slot 95 of the first seat 24' and into the slot 96 of the second seat 23', to implement a fixed coupling by obstacle for both of them. Then, the closing means 4' fixes simultaneously and mutually the covering element 1, the containment group 2' and the support body 3'.

The present invention has been sofar described with reference to preferred embodiments. It is to be meant that other embodiments belonging to the same inventive core may exist, as defined by the protective scope of the herebelow reported claims.

The invention claimed is:

1. A portable safety container, configured also for fixed installation, comprising:

a main body having a containment structure and a covering element, said containment structure and covering element being configured to selectively couple to define a closed safety compartment, wherein said containment structure has a first seat;

a closing device integral with said covering element, said closing device configured to selectively lock said covering element with said containment structure and also configured to selectively lock said main body with a support body fixed, in use, to a wall or to an equivalent element, said closing device having a first portion and a second portion, wherein said first portion is configured to be selectively received in said first seat of said containment structure and wherein said second portion is configured to be selectively coupled in a fixed manner with a second seat associated to the support body, wherein the overall configuration of said security container is configured to provide:

an open arrangement, wherein said first and second portion of said closing device are uncoupled respectively from said first seat and from the second seat;

a first closing arrangement, wherein said first portion implements a fixed coupling with said first seat, which corresponds to a locking of said covering element with said containment structure, whereas said second portion remains uncoupled with respect to the second seat of the support body; and a second closing arrangement, wherein one of said first portion and second portion implements a fixed coupling with said first seat, which corresponds to a locking of said covering element with said containment structure, and said second portion implements a fixed coupling with the second seat of the support body, which corresponds to a locking of said main body on the support body, wherein said first closing arrangement is configured to correspond to a first rotation of said closing device by a first predetermined angle with respect to said opening arrangement and wherein said second closing arrangement is configured to correspond to a second rotation of said closing device by a second predetermined angle with respect to said first closing arrangement, and wherein said second portion of said closing device has a first segment externally threaded and the second seat has a second segment internally threaded, said threads of said first and second segments being sized to couple to each other by means of said second rotation of said closing device.

2. The portable safety container according to claim 1, wherein said first seat has a cylindrical or tapered development.

3. The portable safety container according to claim 1, wherein said closing device comprises a keyhole configured for the insertion of a corresponding key or it is configured to be actuated by electronic key.

4. The portable safety container according to claim 1 wherein, in said second closing arrangement, said first portion implements a fixed coupling with said first seat, which corresponds to a locking of said covering element with said containment structure, and said second portion implements a fixed coupling with the second seat of the support body which corresponds to a locking of said main body on the support body.

5. The portable safety container according to claim 1, wherein said first portion of said closing device comprises a traditional cylinder-bolt type mechanism adapted to implement said fixed coupling with said first seat by means of said first rotation of said closing device.

6. The portable safety container according to claim 1, wherein said second portion of said closing device has a terminal end having one or more interference elements with the second seat, and wherein the second seat bears one or more openings shaped to allow the passage of said interference elements at said opening arrangement and first closing arrangement, the one or more openings being further shaped to prevent the passage of said interference elements at said second closing arrangement thereby implementing a fixed coupling between the support body and said main body.

7. The portable safety container according to claim 1, wherein said first seat and the second seat comprise respectively at least a first and a second slot, positioned so that under use configuration they result to be overlapped, wherein said first portion can be selectively received in said first slot and said second portion can be selectively received in said first and in the second slot, wherein in said first closing arrangement, said first portion is received in said first slot, which corresponds to a locking of said covering element with said containment structure, whereas said second portion remains uncoupled with respect to the second seat of the support body; and in said second closing arrangement, said second portion is received simultaneously in said first and in the second slot to implement:

a fixed coupling with said first seat, which corresponds to a locking of said covering element with said containment structure, and a fixed coupling with the second seat of the support body, which corresponds to a locking of said main body on the support body.

8. The portable safety container according to claim 7, wherein the passage from said open arrangement to said first closing arrangement and the passage from said first closing arrangement to said second closing arrangement are implemented by means of a progressive translation of said closing device, respectively.

9. The portable safety container according to claim 1, wherein said containment structure comprises a holding element and a corresponding inner lining element.

10. A security system, comprising a portable safety container according to claim 1 and said support body for housing said closing device.

11. The security system according to claim 10, wherein said support body is arranged to allow the attachment of said portable safety container to a support structure by fixing members, to implement a fixed installation mode.

12. The security system according to claim 10, wherein said second seat has a cylindrical or tapered development.

13. The security system according to claim 10, wherein said first and second seats are configured to be coaxial, and concentric, in use.

14. The security system, comprising a safety container according to claim 1 and elements for actuating said closing device.

15. The security system according to claim 14, wherein said actuating elements are configured to actuate said closing device according to a rotation or translation motion inside said first and second seats.

16. The portable safety container of claim 1, wherein the closing device is a lock, said lock being integral with said covering element.

17. The portable safety container of claim 2, wherein said first seat has a substantially frusto-conical development.

18. The portable safety container of claim 1, wherein said second predetermined angle is equal to said first predetermined angle.

19. The security system according to claim 12, wherein said second seat has a substantially frusto-conical development.

* * * * *